US007900563B2

(12) United States Patent
Frediani

(10) Patent No.: US 7,900,563 B2
(45) Date of Patent: Mar. 8, 2011

(54) REINFORCING ASSEMBLY FOR A TUBULAR CROSS MEMBER OF A RAIL AND TRAM CAR BOGIE

(75) Inventor: Aldo Frediani, Pisa (IT)

(73) Assignee: Ansaldobreda S.p.A., Naples (IT)

( * ) Notice: Subject to any disclaimer, the term of this patent is extended or adjusted under 35 U.S.C. 154(b) by 263 days.

(21) Appl. No.: 11/815,573

(22) PCT Filed: Feb. 3, 2006

(86) PCT No.: PCT/IB2006/000205

§ 371 (c)(1),
(2), (4) Date: Nov. 10, 2008

(87) PCT Pub. No.: WO2006/082505

PCT Pub. Date: Aug. 10, 2006

(65) Prior Publication Data

US 2009/0133600 A1 May 28, 2009

(30) Foreign Application Priority Data

Feb. 4, 2005 (IT) ..... TO2005A0064

(51) Int. Cl.
*B61F 3/00* (2006.01)

(52) U.S. Cl. ..... 105/182.1; 106/206.1; 106/172; 106/174; 106/173; 106/190.1; 464/181; 464/183

(58) Field of Classification Search ..... 105/182.1, 105/206.1, 172, 174, 173, 190.1; 464/181, 464/183; 384/276, 280, 281
See application file for complete search history.

(56) References Cited

U.S. PATENT DOCUMENTS

| | | | | | |
|---|---|---|---|---|---|
| 1,731,510 | A | * | 10/1929 | Todd | 105/202 |
| 2,253,042 | A | * | 8/1941 | Muchnic | 105/182.1 |
| 2,915,021 | A | * | 12/1959 | Bleibtreu | 105/197.1 |
| 3,584,473 | A | * | 6/1971 | MacDonald et al. | 464/90 |
| 3,734,580 | A | * | 5/1973 | Piscitelli | 384/131 |
| 3,808,838 | A | * | 5/1974 | Bowen et al. | 464/89 |
| 3,915,095 | A | * | 10/1975 | Briggs | 105/202 |
| 3,939,779 | A | * | 2/1976 | Pringle | 105/180 |
| 4,161,913 | A | * | 7/1979 | Guillaumin | 105/200 |
| 4,362,109 | A | * | 12/1982 | Panagin | 105/182.1 |
| 4,572,487 | A | * | 2/1986 | Slagley | 266/270 |
| 5,346,261 | A | * | 9/1994 | Abbema | 285/22 |
| 5,462,706 | A | * | 10/1995 | McMillan et al. | 264/138 |
| 5,547,228 | A | * | 8/1996 | Abbema et al. | 285/22 |
| 5,794,982 | A | * | 8/1998 | Green et al. | 285/55 |
| 5,984,370 | A | * | 11/1999 | Lewis | 285/22 |
| 6,010,407 | A | * | 1/2000 | Ishikawa | 464/52 |

(Continued)

FOREIGN PATENT DOCUMENTS

EP 0564423 4/1993

(Continued)

*Primary Examiner* — S. Joseph Morano
*Assistant Examiner* — Jason C Smith
(74) *Attorney, Agent, or Firm* — Greenblum & Bernstein P.L.C.

(57) ABSTRACT

A reinforcing assembly for a tubular cross member of a rail and tram car bogie has a liner elongated along an axis, deformable radially, and insertable axially inside one end of the tubular cross member to line an inner cylindrical surface of the end; a tubular body insertable coaxially inside the liner; and a number of radial forcing devices, which are activated to force the tubular body, and hence the liner, radially outwards to lock the liner frictionally against the inner cylindrical surface of the cross member.

15 Claims, 3 Drawing Sheets

U.S. PATENT DOCUMENTS

| | | | | |
|---|---|---|---|---|
| 6,176,525 | B1 * | 1/2001 | McMillan et al. | 285/55 |
| 7,025,144 | B2 * | 4/2006 | Haugen et al. | 166/313 |
| 7,344,161 | B2 * | 3/2008 | Howard et al. | 285/48 |
| 2006/0131469 | A1 * | 6/2006 | Roy | 248/346.03 |
| 2009/0133600 | A1 * | 5/2009 | Frediani | 105/182.1 |
| 2009/0198219 | A1 * | 8/2009 | Campbell et al. | 604/524 |
| 2009/0293980 | A1 * | 12/2009 | Burke, II | 138/109 |

FOREIGN PATENT DOCUMENTS

| | | | |
|---|---|---|---|
| EP | 1095838 | A2 * | 5/2001 |
| FR | 2348091 | | 11/1977 |
| FR | 2632918 | | 12/1989 |
| FR | 0857635 | | 8/1998 |
| GB | 411999 | | 6/1934 |
| GB | 1439655 | | 6/1976 |

* cited by examiner

REINFORCING ASSEMBLY FOR A TUBULAR CROSS MEMBER OF A RAIL AND TRAM CAR BOGIE

TECHNICAL FIELD

The present invention relates to a reinforcing assembly for a tubular cross member of a rail and tram car bogie, and in particular for a tubular cross member of an underground train motor-driven bogie.

BACKGROUND ART

As is known, the motor-driven bogie of a rail and tram car comprises a frame defined by two side members, and by two cross members spaced apart in the longitudinal travelling direction of the train. The side members support a rotary front and rear axle, each fitted with two wheels mounted to run along rails, and the cross members support two motor reducers and two brake assemblies for driving and braking the axles.

The cross members have a tubular structure, and ends extending inside respective holes in the side members and welded to the side members. When running, fatigue failure sometimes occurs at the weld connection between the tubular cross member and the side member, and is presumably caused by a combination of technological weld defects (e.g. irregular weld bead, stuck welds, solid inclusions, lack of fusion, relative positioning errors between the cross member and the hole in the side member) and anomalous stress conditions not covered in standard tests and current regulations.

Fatigue cracks, in particular, are found to substantially originate in a horizontal plane corresponding to the mid-plane of the cross members, and are therefore presumably caused by bending moments having an approximately vertical axis and so produced by fatigue loads acting longitudinally on the side members. In-service strain gauge readings actually tend to show, particularly when the train is travelling along curves, anomalous stress on the frame caused by so-called "rhombusing" of the side members of the bogie, i.e. stress caused by a longitudinal load acting on each wheel in opposite directions on the two sides of the bogie.

A need is therefore felt to reinforce the tubular cross members of existing bogies, by performing repair and/or updating work at ambient temperature, without dismantling the bogies, and with no need for machining the cross members.

DISCLOSURE OF INVENTION

It is an object of the present invention to provide a reinforcing assembly for a cross member of a rail and tram car bogie, designed to meet the above demand in a straightforward, low-cost, reliable manner, preferably by permitting fast repair and maintenance work.

According to the present invention, there is provided a reinforcing assembly for a tubular cross member of a rail and tram car bogie; the assembly being characterized by comprising:

- a liner elongated along an axis, deformable radially, and insertable axially inside one end of said tubular cross member to line an inner cylindrical surface of said end; and
- radial forcing means insertable axially inside said liner, and which are activated to force said liner radially outwards to lock the liner, in use, against said inner cylindrical surface.

BRIEF DESCRIPTION OF THE DRAWINGS

A non-limiting embodiment of the invention will be described by way of example with reference to the accompanying drawings, in which.

BEST MODE FOR CARRYING OUT THE INVENTION

Figure 1:
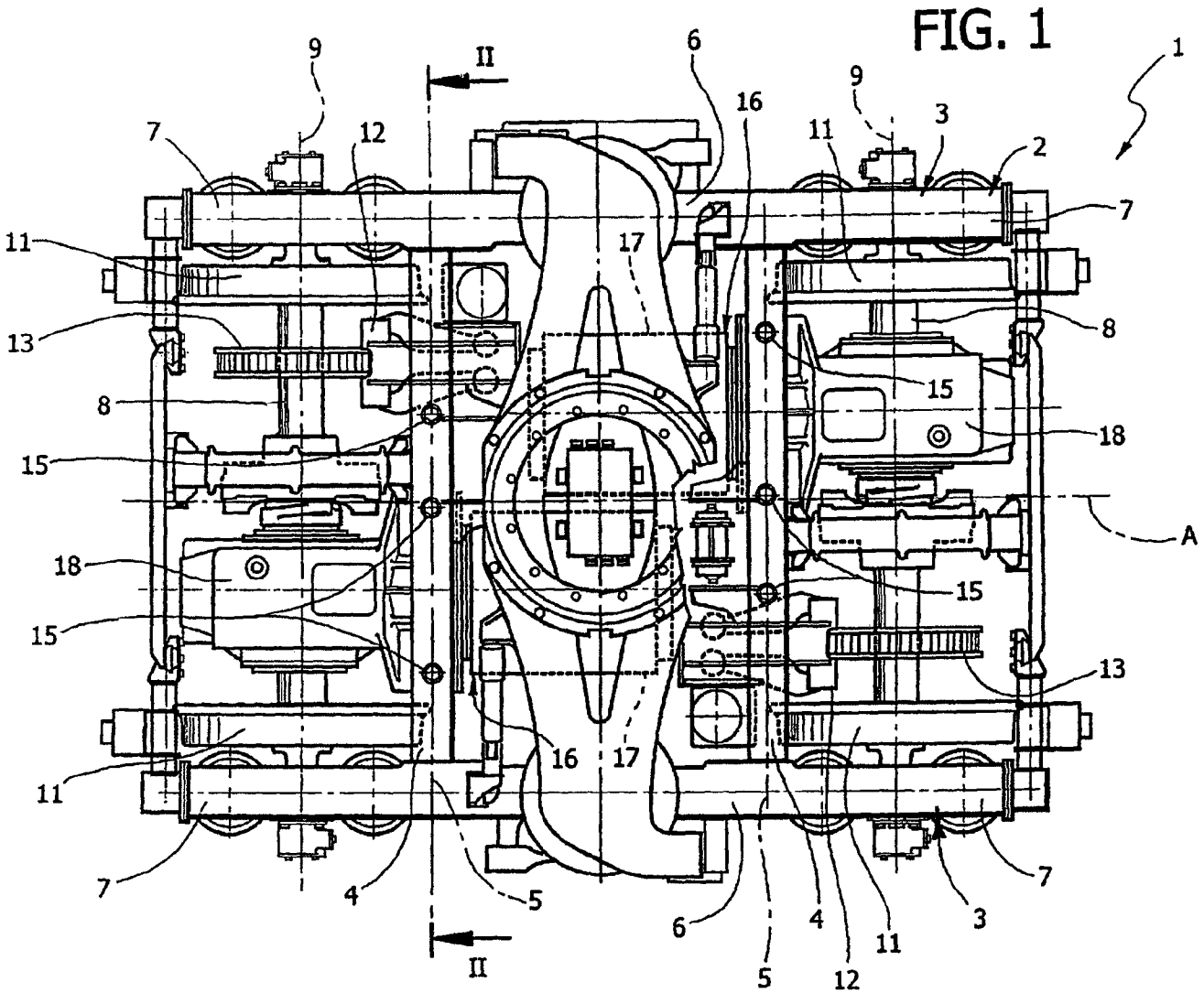
FIG. 1 shows a partial plan view of a rail and tram car bogie.

Number 1 in FIG. 1 indicates a motor-driven bogie (shown partly) of a rail and tram car (not shown). Bogie 1 comprises a frame 2, in turn comprising two side members 3, and two cylindrical tubular cross members 4 spaced longitudinally apart and extending along respective horizontal axes 5 perpendicular to the longitudinal travelling direction A of bogie 1. Side members 3 comprise respective intermediate portions 6 having a substantially U-shaped lateral profile, and terminate with respective opposite longitudinal arms 7 supporting a front axle and a rear axle, both indicated 8. Axles 8 rotate about respective fixed horizontal axes 9, are fitted with wheels 11 mounted to run on rails (not shown), and are located on opposite sides of cross members 4.

Figure 2:
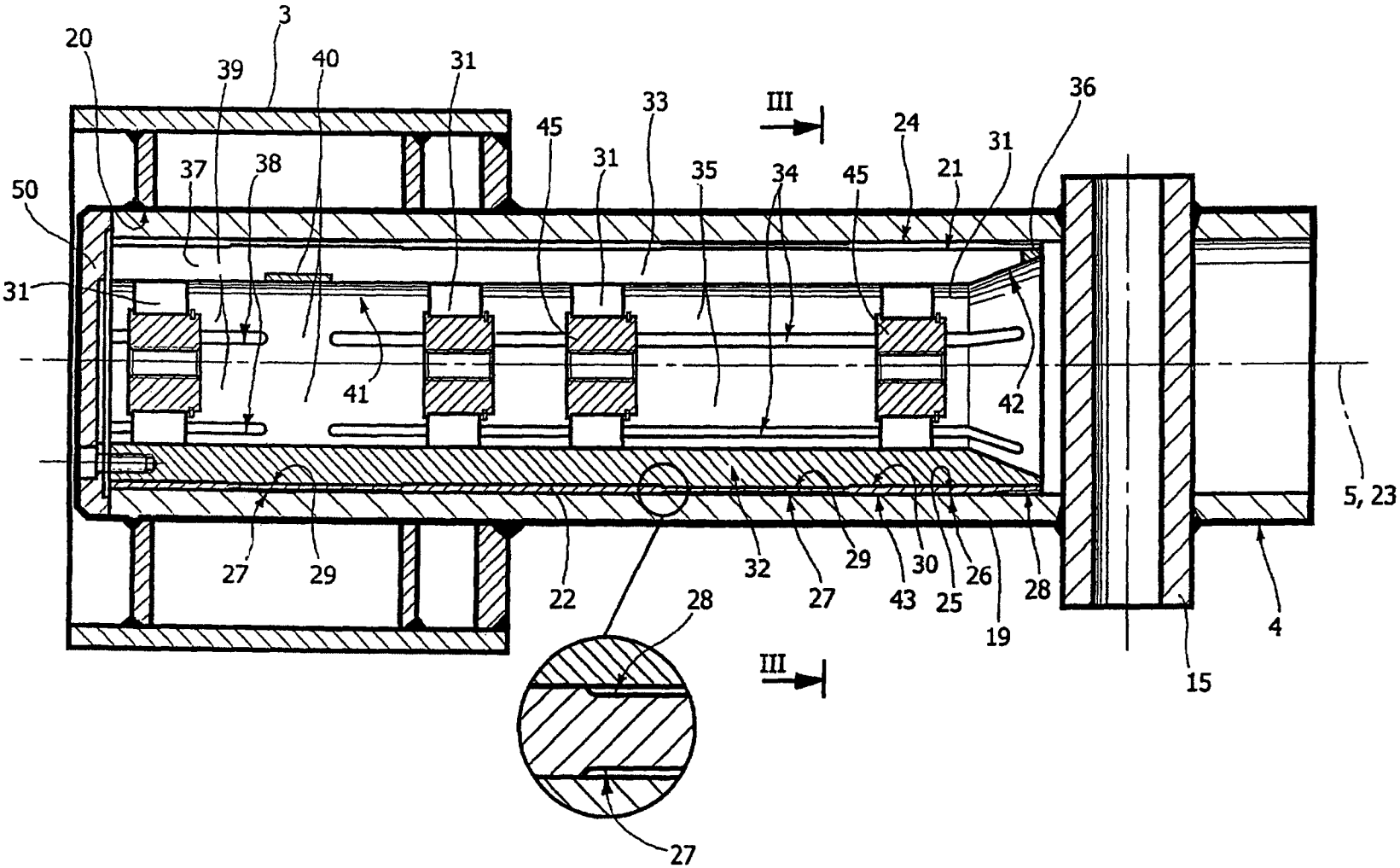
FIG. 2 shows a section along line II-II in FIG. 1, and a preferred embodiment of a reinforcing assembly for a tubular cross member of a bogie in accordance with the present invention.

With reference to FIGS. 1 and 2, the bogie also comprises two brake assemblies 12, which are fitted to respective supports—not described in detail, and each welded circumferentially to a relative cross member 4—and cooperate frictionally with respective disks 13 fixed to axles 8.

Each cross member 4 has three connecting points defined by respective sleeves 15 spaced apart axially, and extending vertically through, and welded to, cross member 4. The six sleeves 15 support—in known manner not described in detail—two motor reducers 16 for driving axles 8, and each defined by a relative electric motor 17 and a relative reducer 18.

With reference to FIG. 2, the ends 19 of cross members 4 engage respective holes 20 in side members 3, and are welded to side members 3 in known manner not described in detail. To increase the rigidity, and therefore reliability, of the weld connections between side members 3 and cross members 4, each end 19 is provided with a respective reinforcing assembly 21, which, at the assembly stage, is inserted axially inside end 19, working from the outer side of bogie 1.

Figure 3:
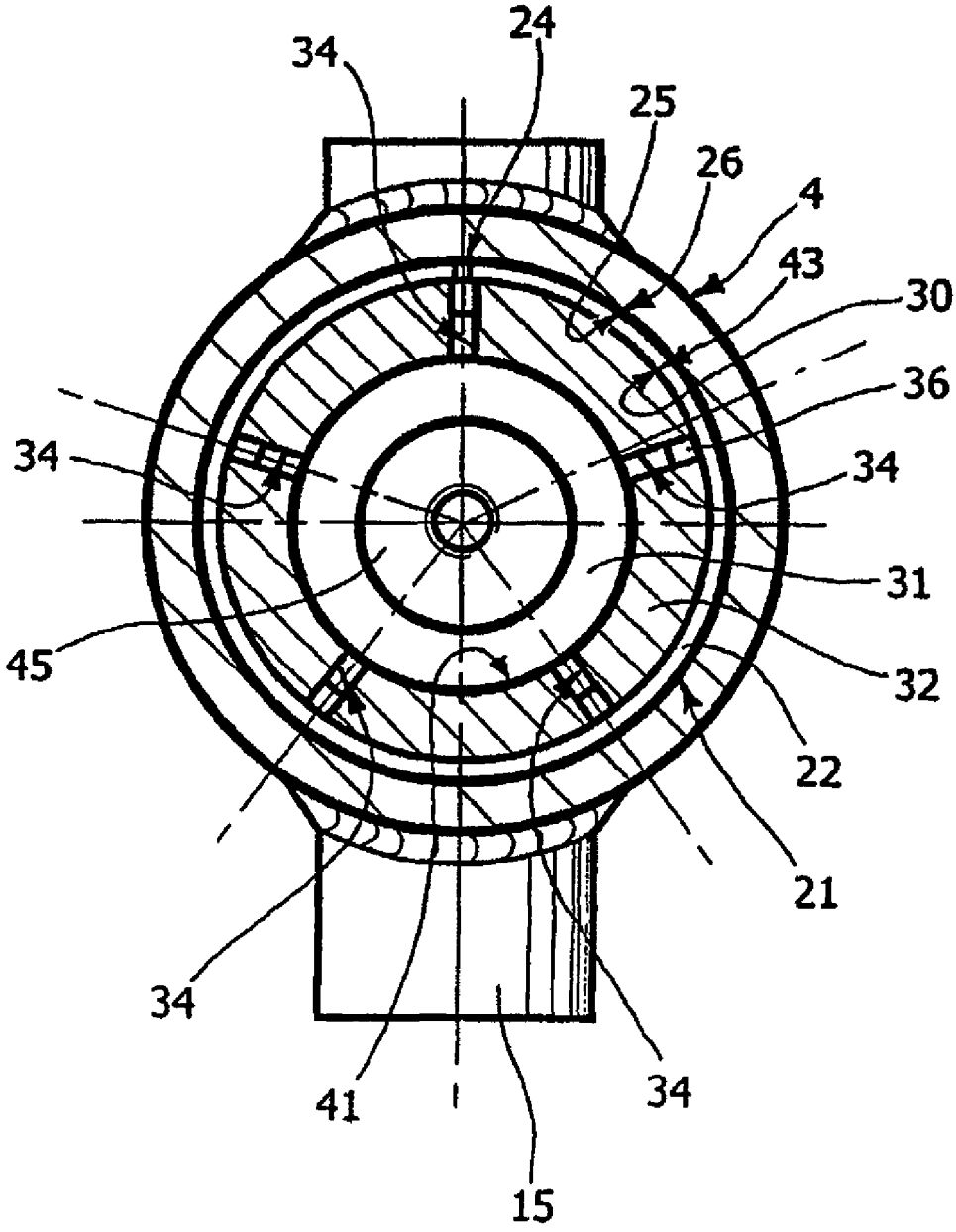
FIG. 3 shows a section along line III-III in FIG. 2.

With reference to FIGS. 2 and 3, assembly 21 comprises a liner 22, which is elongated along an axis 23 (substantially coinciding, in use, with axis 5) and defined by a cylindrical metal wall made of steel and having an open section along a longitudinal opening 24 defined by a cut along the whole axial length of liner 22.

Liner 22 is elastically deformable radially along its whole axial length by virtue of opening 24, is formed by cutting along a generating line of a cylindrical tube (not shown), and, when not deformed, has an outside diameter equal to the inside diameter of end 19 plus roughly 2 millimeters, and an inside diameter equal to the inside diameter of end 19 minus roughly 5 millimeters. More specifically, the inside diameter of ends 19 is measured directly on the cross members 4 requiring maintenance and reinforcement by means of assemblies 21.

Liner 22 therefore has a radial thickness of about 7 millimeters, lines an inner cylindrical surface 25 of end 19, extends at most up to about 15 millimeters short of sleeve 15 (i.e. up to about 45 millimeters from the sleeve axis), and has an outer lateral surface 26 which is cylindrical, except for opening 24, for two axially spaced outer circumferential recesses 27, and for a conical end portion 28 tapering towards axis 23 and defining a lead-in portion by which to insert liner 22 inside cross member 4.

More specifically, recesses 27 have a radial depth of about 0.2 of a millimeter, and are formed in axial positions corresponding to those of relative recesses 29, of the same radial depth, formed on an inner cylindrical surface 30 of liner 22.

Assembly 21 also comprises a number of radial forcing devices 31; and a cylindrical tubular body 32, or so-called "plug", coaxial with liner 22 and interposed between liner 22 and devices 31.

Body 32 comprises an intermediate portion 33 having a number of straight longitudinal slits 34, which divide portion 33 circumferentially into radially deformable sectors 35, and are closed axially at the end of body 32 by a continuous annular portion 36. Body 32 also comprises an end portion 37 opposite portion 36 and having a number of straight longitudinal slits 38, which are aligned with slits 34, are open axially at the end of body 32, and divide portion 37 circumferentially into radially deformable sectors 39.

Slits 38, 34 are separated axially by respective plate portions 40, which are thinner radially than sectors 39, 35 and flush with an inner cylindrical surface 41 of body 32. Towards the end defined by portion 36, surface 41 terminates with an outwardly-flared conical portion 42, on which the ends of slits 34 are formed.

Body 32 also has an outer cylindrical surface 43, which, at sectors 35, 39, is forced onto surface 30 by the radial thrust exerted by devices 31.

Devices 31 are arranged along axis 23, are located along portions 33, 37, in positions spaced axially apart from recesses 27, 29, and are defined by shaft fitting devices, e.g. of the type known by the trade name "Tollok" (registered trademark). More specifically, each device 31 is mounted on a respective central supporting pin 45 having a threaded axial hole by which to position and extract pin 45 by means of a threaded bar (not shown). Each device 31 comprises a respective pair of rings (not shown), which are slid axially along pin 45 with respect to each other by a screw-nut screw coupling (not shown); and a respective radially-expandable outer member (not shown), which is fitted to the outer periphery of said rings by a wedge coupling, and is movable radially outwards, when the rings are moved towards each other by axially tightening the screw-nut screw coupling, to force sectors 35, 39 against liner 22 and so frictionally lock liner 22 against surface 25.

To assemble assembly 21, firstly, surface 25 of cross member 4 is degreased, any surface roughness is removed from surface 25, the edges of opening 24 are ground, and liner 22 is degreased.

Next, liner 22 is inserted axially inside end 19 by forcing portion 28 axially and by radially and elastically compressing liner 22, so that opening 24 is positioned upwards "at twelve o'clock" (FIG. 3).

Next, surface 43 of body 32 is turned to achieve a maximum radial clearance of 0.2 of a millimeter with respect to the inside diameter of liner 22 measured when the liner is deformed and located inside cross member 4.

Once surface 43 is degreased, body 32 is inserted inside liner 22 and locked by successively assembling devices 31.

Finally, a cover 50 is fitted on to close end 19, and is fixed to body 32, e.g. by means of screws.

Once assembled, assembly 21 greatly increases the rigidity of cross member 4, thus reducing fatigue stress levels, by increasing the flexural inertia of cross member 4 where it contacts, and therefore is joined to, side member 3. More specifically, the increase provides for a roughly 30% theoretical reduction in local stress, as compared with a non-modified cross member 4, thus increasing fatigue endurance.

At the same time, assembly 21 defines an alternative route for the stress flow at the joint, in accordance with a so-called "Damage Tolerance" concept. That is, as opposed to being related to the critical length of the weld crack, fatigue failure of cross member 4 now coincides with fatigue failure of body 32, which is capable of transferring the bending moment from cross member 4 to side member 3, even in the event of complete splitting of the weld, provided devices 31 ensure the frictional connection described above. Though subjected to greater nominal stress than cross member 4, body 32, not being cut and having no welds, may be designed for practically infinite fatigue endurance.

Assembly 21 also obviously permits in-shed modification of existing bogies, with no need to dismantle any parts of bogie 1, and provides for a high degree of reliability of the cross member 4/side member 3 connection, with more or less constant, predictable, and therefore programmable maintenance procedures and schedules.

Given the quality, simplicity, and speed of the maintenance work involved, train downtime is minimum. In fact, work is only carried out inside both axial ends of cross member 4, working from the outer side of frame 2, and involves no machining of cross member 4, no reinforcing welds about the existing weld, and no hot forcing.

Slightly conical portion 28 and the undercutting defined by recesses 27 facilitate insertion of liner 22 inside cross member 4, with relatively little axial force required, and at any rate compatible with a straightforward portable hydraulic tool. The solution provided also reduces possible fretting problems in the cross member 4/liner 22 connection, and provides for gradual passage of rigidity to the end of liner 22 defined by portion 28, so as to reduce the notching effect.

Since the inside and outside diameters are defined, bodies 32 are the same for all cross members 4 and all bogies 1, and can therefore be produced on a small scale.

Moreover, using assembly 21, the time lapse between inspections of modified bogies 1 may be extended, thus reducing routine inspection time and cost.

Clearly, changes may be made to assembly 21 as described herein without, however, departing from the scope of the present invention.

In particular, liner 22 may be forced radially and locked against inner surface 25 of cross member 4 using systems other than devices 31 described by way of example; and/or radial deformability of body 32 may be achieved by other than slits 34, 38 and sectors 35, 39 as described and illustrated; and/or body 32 may even be deformed permanently outwards, as opposed to only elastically, to lock liner 22 in place.

Finally, reinforcing assembly 21 may be applied to bogies of any type, not just motor-driven bogies.

The invention claimed is:

1. A reinforcing assembly for a tubular cross member of a rail and tram car bogie, the assembly comprising:

a liner elongated along an axis, deformable radially, and insertable axially inside one end of the tubular cross member to line an inner cylindrical surface of the one end; and a forcer insertable axially inside the liner, and which is activated to force the liner radially outwards to lock the liner, in use, against the inner cylindrical surface, wherein the liner, when not deformed, has an open circular section defined by a longitudinal cut formed along the whole length of the liner.

2. An assembly as claimed in claim 1, further comprising an outer lateral surface of the liner terminates with a portion tapering towards the axis and defining a lead-in portion for axial insertion inside the tubular cross member.

3. An assembly as claimed in claim 1, further comprising an outer lateral surface of the liner having at least one outer circumferential recess.

4. An assembly as claimed in claim 3, further comprising the outer lateral surface of the liner having two axially spaced outer circumferential recesses.

5. An assembly as claimed in claim 3, wherein for each outer circumferential recess, the inner surface of the liner has a respective inner circumferential recess.

6. An assembly as claimed in claim 3, wherein the forcer comprises a number of radial forcing devices arranged, in use, along the axis and spaced axially apart from the outer and inner circumferential recesses.

7. An assembly as claimed in claim 1, further comprising the liner, when not deformed, has an outside diameter greater than the inside diameter of the tubular cross member, and is deformable elastically when being inserted axially inside the tubular cross member.

8. An assembly as claimed in claim 1, wherein the forcer comprises a number of radial forcing devices; and a cylindrical tubular body insertable coaxially inside the liner and comprising at least one deformable portion deformable radially against the inner surface of the liner by the radial thrust of the radial forcing devices.

9. An assembly as claimed in claim 8, wherein the deformable portion comprises longitudinal first slits dividing the deformable portion circumferentially into a first number of radially deformable sectors.

10. An assembly as claimed in claim 9, wherein the tubular body comprises an end portion having longitudinal second slits dividing the end portion circumferentially into a second number of radially deformable sectors.

11. An assembly as claimed in claim 10, wherein the first and second slits are separated axially by plate portions of a radial thickness smaller than that of the first and second number of sectors.

12. An assembly as claimed in claim 11, wherein the plate portions are flush with an inner cylindrical surface of the tubular body.

13. An assembly as claimed in claim 9, wherein the tubular body has an inner cylindrical surface terminating axially, at one end, with an outwardly flaring portion; and the first slits being formed partly in the flaring portion.

14. An assembly as claimed in claim 1, wherein the forcer comprises a wedge; and a screw-nut that can be tightened axially to activate the wedge.

15. An assembly as claimed in claim 1, further comprising the liner being defined by a metal wall.

* * * * *